US008126251B2

(12) United States Patent
Saltsov et al.

(10) Patent No.: US 8,126,251 B2
(45) Date of Patent: Feb. 28, 2012

(54) PHOTO SENSOR ARRAY FOR BANKNOTE EVALUATION

(75) Inventors: Leon Saltsov, Thornhill (CA); Dmitro Baydin, Toronto (CA); Gennadiy Gaponyuk, Newmarket (CA); Vitold Khvostov, Kiev (UA); Dmytro Repetyuk, Thornhill (CA)

(73) Assignee: Crane Canada Co., Concord, ON (CA)

( * ) Notice: Subject to any disclaimer, the term of this patent is extended or adjusted under 35 U.S.C. 154(b) by 629 days.

(21) Appl. No.: 11/990,595

(22) PCT Filed: Aug. 17, 2006

(86) PCT No.: PCT/CA2006/001348

§ 371 (c)(1),
(2), (4) Date: Apr. 9, 2009

(87) PCT Pub. No.: WO2007/019696

PCT Pub. Date: Feb. 22, 2007

(65) Prior Publication Data

US 2009/0208088 A1 Aug. 20, 2009

(30) Foreign Application Priority Data

Aug. 19, 2005 (CA) ..... 2516561

(51) Int. Cl.
*G06K 9/00* (2006.01)
*G07F 7/04* (2006.01)

(52) U.S. Cl. ..... 382/135; 194/206

(58) Field of Classification Search ..... 382/135, 382/136, 137, 138, 139, 140, 321; 194/206, 194/208, 209, 210, 211, 212, 213, 214, 215; 235/17, 379; 73/1.22, 1.41, 1.45, 1.56; 902/7, 902/28

See application file for complete search history.

(56) References Cited

U.S. PATENT DOCUMENTS 7,084,416 B2 * 8/2006 Suzuki ..... 250/556
7,542,598 B2 * 6/2009 Jones et al. ..... 382/135

* cited by examiner

*Primary Examiner* — Abolfazl Tabatabai

(57) ABSTRACT

A banknote acceptor illuminates a banknote as it passes through an evaluation channel in a manner to locate the banknote in the width of the channel. A photo sensor array receives reflected light from the surface of the banknote and has a series of responsive divisions across an illuminated banknote. These divisions are sampled and analysed according to the banknote position to determine the authenticity of the banknote. Both apparatus and method steps are disclosed.

12 Claims, 3 Drawing Sheets

PHOTO SENSOR ARRAY FOR BANKNOTE EVALUATION

FIELD OF THE INVENTION

The invention relates to a photo sensor array for banknote evaluation as well as a method of banknote evaluation. In particular the photo sensor array illuminates the banknote as it moves past the sensing arrangement and information is gathered from at least 75% of the banknote surface.

BACKGROUND OF THE INVENTION

Banknote evaluation is now commonly carried out and has become more critical in that the technology available to produce counterfeit bills is easily available and the quality of counterfeit bills has significantly increased. Currency of major countries continues to add different security features to their banknotes so that fraudulent banknotes are more easily detected and to act as a deterrent to the production of counterfeit bills.

Unattended currency accepting equipment such as vending machines, token dispensing machines, and other automated equipment include banknote acceptors. The banknote acceptors transport banknotes along an evaluation path and conduct various tests to predict the authenticity thereof. These banknote acceptors typically include optical sensors having an illumination source for illuminating a particular strip of the banknote as it moves through the evaluation path. The optical sensors include detectors for evaluating reflected light and can include filtering for light evaluation at different frequencies.

Banknote acceptors typically include a series of optical sensors that evaluate strips of a banknote to detect different security features provided at different positions on the banknote. Such evaluators often include different sensors for determining the magnetic, electrostatic, transparency and other characteristics of the banknote. Such banknote acceptors include sufficient optical sensors for evaluating critical aspects of different denominations of banknotes to be received and as such, the optical sensors are placed at different points across the evaluation path. There is a compromise between the number of sensors used to scan the surfaces of the banknote and the cost of the banknote acceptor. Full scanning of the banknote surface provides more data and can improve the prediction of whether the banknote is authentic or not, but the additional cost is difficult to justify, and furthermore, there is a time restraint for the effective analysis of the data.

Typically if the banknote moves slower along the banknote evaluation path or more time is provided to allow the banknote acceptor to consider all of the data, improvements in the prediction can be obtained. Unfortunately, from a customer point of view, the evaluation process must be essentially completed in real time; otherwise the transaction may be discontinued. In some applications it may be more profitable to accept additional risk in accepting a counterfeit banknote as opposed to an increase in the transaction time and improved evaluation of the banknote.

A further problem associated with existing banknote evaluation systems involves variations in the placement of the banknote within the evaluation path. The banknote can be fed to the evaluation path at a slight angle and/or the evaluation path can be larger than the width of the banknote and thus, the precise position of the strip being illuminated is within a range but is not precisely known. These factors also affect the accuracy of the banknote evaluation.

There continues to be a need to provide effective banknote evaluation quickly and at an acceptable cost.

The present invention provides an effective solution that addresses a number of these issues.

SUMMARY OF THE INVENTION

A method of banknote evaluation according to the present invention comprises moving a banknote along an evaluation path past an optical sensing arrangement where the precise location of the banknote, relative to the optical sensing arrangement is not known. The method includes using the optical sensing arrangement to generally illuminate the banknote as it moves past the sensing arrangement and focusing reflected light from the illuminated banknote surface onto a photo array to provide a strip analysis corresponding to at least 75% of the banknote surface.

The strip analysis contains at least 50 divisions and the strip analysis is used to determine the position of the banknote relative to the optical sensing arrangement. Once the position is known, the at least 50 divisions are selectively used to evaluate the authenticity of the banknote relative to a standard. With this arrangement, improved analysis is possible as the relatively position of the 50 divisions within to the width of the banknote is known and it is not necessary to have the substantial tolerances necessary when the precise position of the banknote is not known.

According to an aspect of the invention, the method includes evaluation of an angle of the illuminated banknote relative to the optical sensing arrangement in selecting the divisions used in the evaluation of the banknote for authenticity.

In a different aspect of the invention, the reflected light is focused onto a photo array having at least 64 pixels and each pixel forms a division.

In a further aspect of the invention, the illuminating step associated with the optical sensing arrangement illuminates across a width of the evaluation path such that 100% of the surface of the banknote facing the optical sensing arrangement is illuminated and the photo array receives reflected light across the width of the evaluation channel.

In a further aspect of the invention, the full illumination of the banknote surface is used to determine the edge regions of the banknote relative to the photo array and the evaluation uses only the divisions representing a response from the banknote.

In a further aspect of the invention, the step of focusing includes at least three lenses to converge the reflected light onto the photo array.

In a further aspect of the invention, the step of selectively using the at least 50 divisions includes a series of evaluations of different divisions that vary according to the determined position of the banknote.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
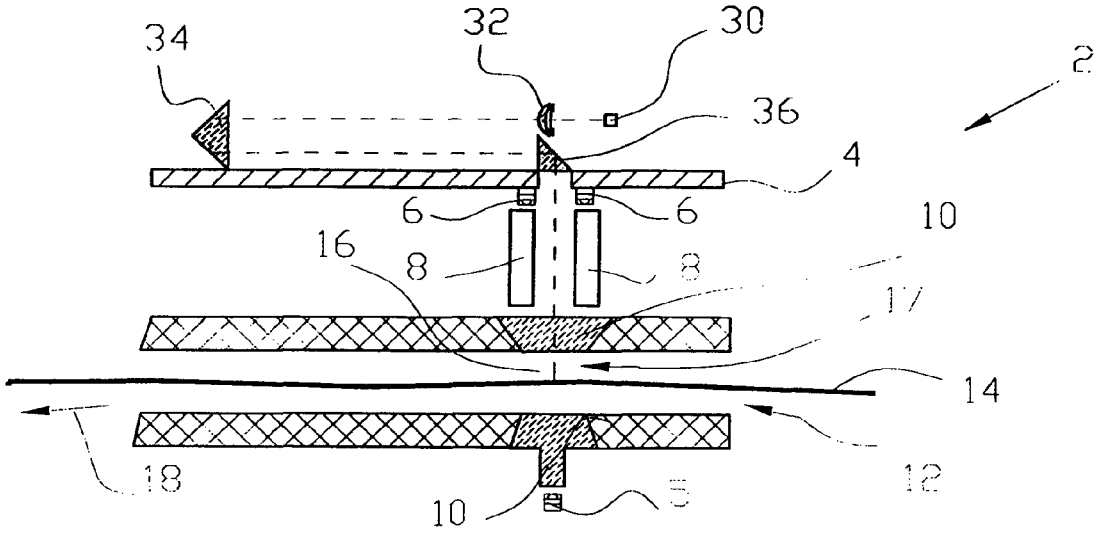
FIG. 1 is a side view through a banknote evaluation path illustrating the photo sensor array and lens arrangement.
Figure 2:
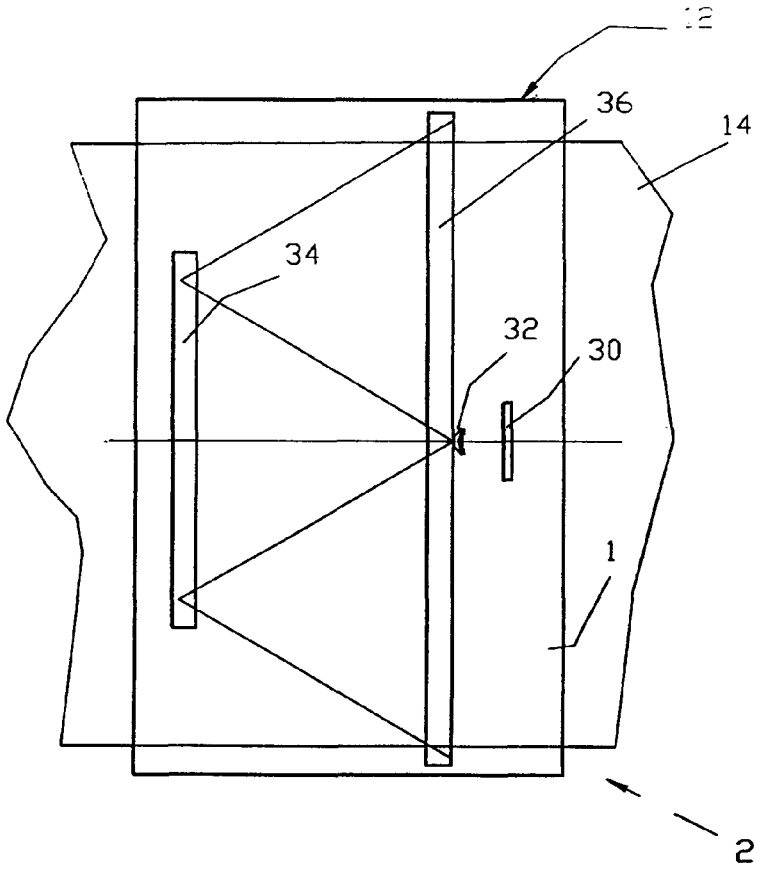
FIG. 2 is a top view of the photo sensor array and lens arrangement.

The optical sensing arrangement 2 shown in FIGS. 1 and 2 provide details of the various components and their position relative to the banknote evaluation path 12. A banknote 14 is being advanced past the evaluation position generally shown as 17 and the upper surface 16 of the banknote is being illuminated.

The various components are secured on the PCB board 4 and includes the light emitting LCDs shown as 6. As can be appreciated, the evaluation of banknotes is carried out at different frequencies, and therefore, different LCDs can be provided for fully illuminating across the width of the banknote 14, and across the width of the evaluation channel at the evaluation strip 17. Certain LCDs may focus on a certain strip region of the banknote whereas the detector receives a response from across the width of the evaluation path. Various arrangements for this illumination of the banknote and the evaluation channel can be provided. In this case, focusing optical member 8 receives the light of the LCD 6 and appropriately illuminates the banknote 14 across its width. The light passes through the window 10 in the banknote evaluation path 12. It can be appreciated this window can also provide a desired focusing or distribution of the emitted light.

Other arrangements for illumination of the banknote can be provided.

The exact position of the banknote 14 across the width of the evaluation channel 12 is typically not precisely known. Some tolerance in this position is provided to simplify feeding of the banknote into a banknote acceptor and the width of a banknote may vary depending upon the particular currency. Furthermore, as shown in FIG. 1, the exact position of the banknote relative to the optical sensing arrangement 2 can also vary. The banknote 14 is typically moved past the optical sensing arrangement 2 as indicated by the direction of banknote travel 18. The position of the banknote in the height of the evaluation path varies as the banknote can include crease lines etc. and the path is oversized to reduce the possibility of jamming.

The present optical sensing arrangement 2 focuses the reflected light from the evaluation strip 17 onto the photo sensor array 30. The initial reflected light passes through the window 10 to the converging deflector 36 which directs the reflected light towards the converging deflector 34 which redirects the light towards the objective lens 32. The objective lens 32 then focuses the light on the photo sensor array 30.

As shown in FIG. 2, each of the converging deflectors 34 and 36 converge the light and these deflectors are placed on the PCB board 4 at a spaced distance one from the other, effectively along the length of the banknote evaluation path to allow effective converging of the light while maintaining the quality thereof.

The photo sensor array 30 receives light from across the banknote evaluation path and this light is provided along the length of the photo sensor array 30. The upper surface of the banknote 16 reflects light which is initially reflected and converged by the deflector 36. This deflector can be a prism member as shown in FIG. 1 but also preferably, starts the converging of the light as indicated in FIG. 2. The converging of the light is continued by the second converging deflector 36.

The photo sensor array 30 is one of the components that substantially contributes to the cost of the sensor arrangement, therefore, the number of pixels of the photo sensor array is a trade-off with respect to costs. A photo array having 64 pixels or 128 pixels has proven to be effective.

The first converging deflector 36 has a length almost equal to the width of the path and receives light from the width of the path. In contrast, the second converging deflector 34 is of a shorter length and this member returns the light towards the photo sensor array 30.

Figure 3:
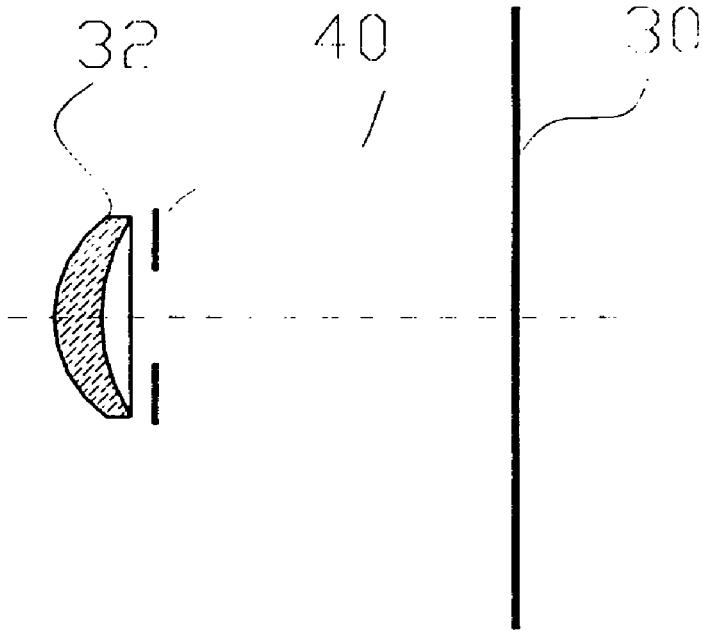
FIG. 3 is a sectional view showing additional details of the final converging lens.

FIG. 3 shows details of the objective lens 32 and the aperture 40 cooperating with the lens to direct light onto the photo sensor array 30. This arrangement allows a viewing angle of approximately 60 degrees and the aperture member 40 effectively limits undesirable light from the photo sensor array 30.

As can be appreciated, the dimensions of the various optical components and their ability to converge and focus the light from the evaluation path onto the photo sensor array 30, determines the amount of separation between the different lenses and also contributes to the cost of the sensor.

Figure 4:
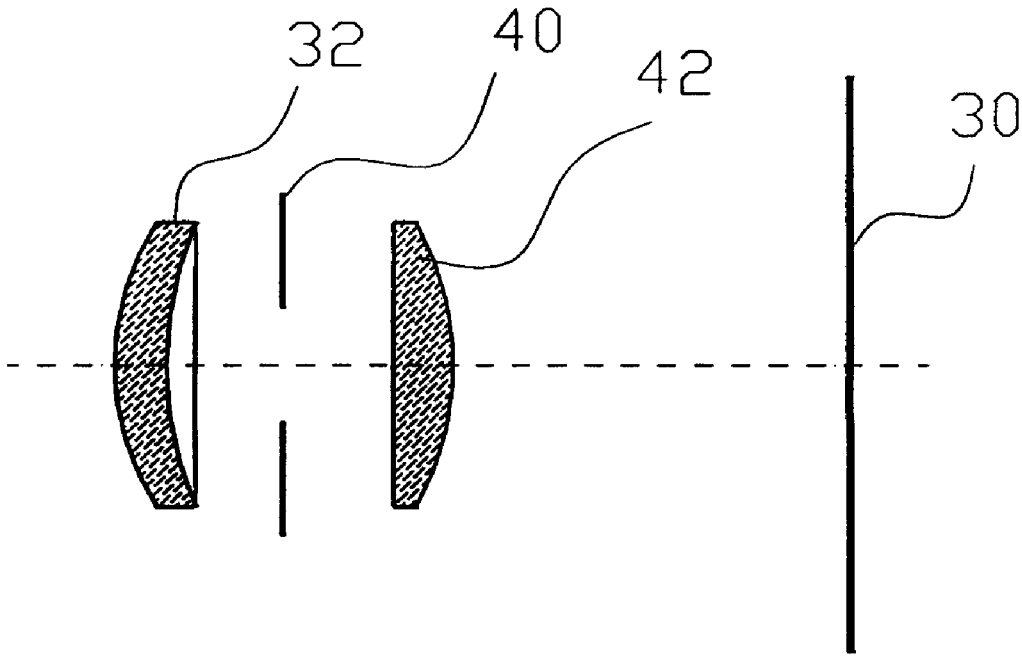
FIG. 4 is a sectional view through an alternate final lens converging arrangement.

FIG. 4 shows a more complex final lens arrangement which includes the additional optical element 42. With this arrangement, the viewing angle is approximately 80 degrees.

Figure 5:
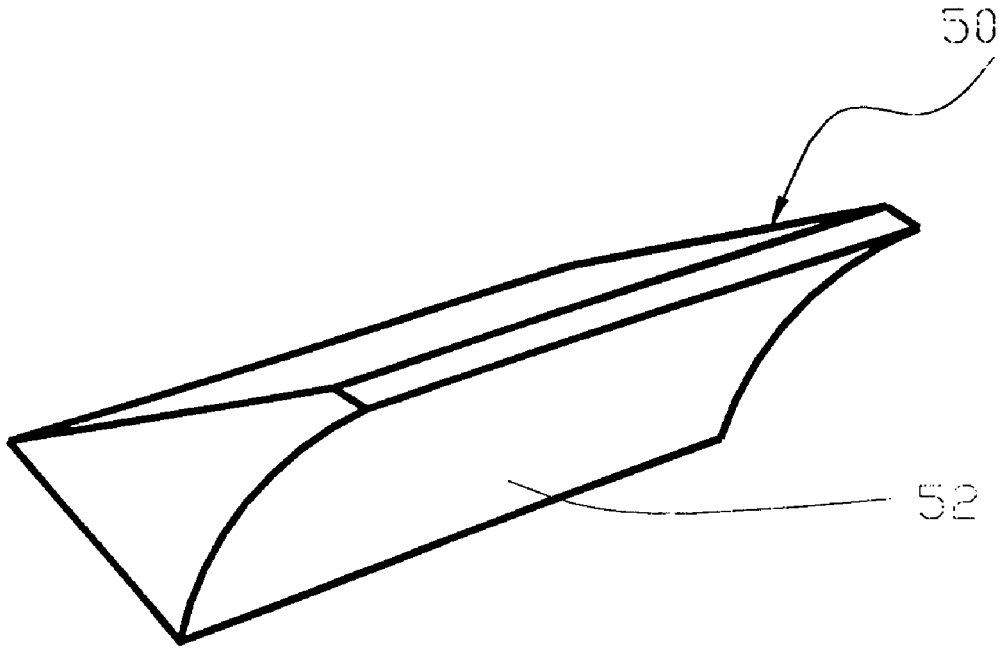
FIG. 5 shows a further variation of one of the deflectors shown in FIG. 1.

FIG. 5 shows a further aspect that can be used regarding the initial deflector 36. In this case, surface 52 which is facing the banknote has been provided with a concave surface to limit the width of the evaluation strip 17. As can be appreciated from the earlier description, the reflected light is being converged and effectively focused along the length of the photo sensor array 30. Accurately locating the strip being evaluated within the photo sensor array provides better data for evaluation. As can be appreciated, the evaluation of the light signal provided to the photo sensor array is sampled as the banknote moves along the banknote evaluation path and analysis of better located data, based on the response of a selected group of the divisions allows for improved accuracy and/or more frequent sampling.

The full illumination of the banknote 14 is particularly advantageous in that it is possible to detect the leading and trailing edges of the banknote as well as the side edges of the banknote and position the banknote in the length of the photo sensor array 30. In this way, the response from the different pixels of the photo sensor array can be more accurately identified across the width of the banknote and therefore, the evaluation software that compares these with standards can be improved. Much of the previous software associated with optical sensors was less accurate as the position of the strip being illuminated could not be precisely determined and was oversized. Therefore, a higher tolerance was required with respect to determining a match in that the response may not become a perfectly aligned banknote. With the present arrangement, the edges of the banknote can be determined and the response from the appropriate divisions of the optical sensor array 30 can be used for comparing against the standard. Furthermore, different portions of the response from the photo sensor array can be used to evaluate other security features including water marks, for example. It is also possible to provide effective comparisons between two or more different strips along the banknote as their positions are effectively known. Basically, the photo sensor array 30 allows more accurate determination of different portions of the banknote or determination of the location of the banknote within the evaluation path. The response of the photo array from the appropriate divisions is then used. Sensing of a banknote edge is desirable but other arrangements are possible for locating of the banknote.

As can be appreciated, the system is based on a photo sensor array and consists of several optical parts that focus light reflected from the banknote and focused onto the pixels of the array. The light that impinges upon each of the pixels is from a corresponding small area of the banknote surface. The system preferably allows collection of information from the full width of the banknote for more accurate evaluation. With this arrangement, it is possible to provide optical sensor arrangements on both sides of the bill and cross comparisons can also be made.

In the embodiment of FIGS. 1 and 2, one or two rows of light emitting diodes 5 can cooperate with the optical elements 8. They are effectively used to direct light from the LEDs to the banknote surface such that the light is essentially uniformly distributed. Different types of LEDs can be used and the LEDs can be of different wavelengths and alternately used or cyclically used one after the other. Therefore, the illumination system can vary considerably depending upon the particular banknotes to be evaluated and the accuracy necessary.

Sensing of the leading edge also allows accurate assessment at different points in the length of the banknote.

A series of optical lenses and deflectors focus light from the banknote to the pixels of the photo sensor array. The light that impinges upon the individual pixels is from only a corresponding small area of the banknote surface. The various optical members provided between the banknote and the photo sensor array 30 cooperates to reduce the overall size of the system while providing effective scanning across the width of the banknote evaluation channel.

The lens arrangement immediately in front of the photo sensor array 30 can either include one lens MENISCUS objective with the MENISCUS made of an organic glass, for example, polycarbonate. It is also possible to use the two lens asymmetric objective where both lenses are made of the same organic glass. With the first lens, the aperture 40 allows a viewing angle of approximately 40 degrees, assuming the photo sensor array has 128 pixels. The two lens system with the restricting aperture therebetween, can provide a vision angle of 60 degrees.

The first deflector 36 is a total reflection prism with an angle of reflection of 90 degrees. The second deflector 34 reflects the light 180 degrees and returns it towards the photo sensor array 30. Due to convergence from the first reflector arrangement, the second deflector is only of a length of about half of the pathway width.

With this system and the full illumination of the banknote, for each sample of the signal from the photo sensor arrays, the edge of the banknote can be determined and the evaluation of the response from the photo sensor arrangement can thus be limited to the particular areas of interest in the banknote by selecting the appropriate pixels to consider.

The system is also capable of selecting which pixels should be considered active pixels. The exact position of the banknote within the evaluation channel does vary and this system allows accurate determination of the active pixels to be compared with the previous samples and the following samples. The active pixel need not be the same for the full length of the banknote and in fact, will probably change. This would be true for a banknote at an angle, for example. The active pixel tracking and determination of the active pixels under evaluation provides improved accuracy and simplifies the comparison with the standard response.

The system also allows for evaluation of certain features that may be provided only on a certain segment of the banknote. For example, a watermark may be provided on a bottom right corner and this system can effectively use the response from the photo sensor array 30 for that portion and when the watermark is illuminated whereby the quality of the watermark can be assessed. This is in contrast to a sensor that is of a very limited width where only a portion of the watermark would be illuminated. As previously mentioned, the light emitting diodes can also be controlled to allow more effective evaluation of these selected portions.

A further aspect of the invention is that security features do not necessarily run in a parallel manner to the edges of a banknote. For example, a security feature may be provided at an angle across a banknote. With the present invention, the evaluation of the different pixels corresponding to angle and position in the length of the banknote can be evaluated. This is possible as the front edge and the side edges are sensed within the width of the path and the appropriate pixels to be considered can be determined. Any changes in the position of the angle of the banknote as it moves through the evaluation channel is also taken into account as the side edge determination can be made for each sample.

A further aspect of the invention is with respect to identifying a particular technique sometimes used in an attempt to defeat the system. It is known to attach a string like member to a banknote to allow withdrawal of the banknote once the banknote acceptor has determined the banknote to be authentic. Strip analysis of banknotes allows a clever individual to appropriately attach the string like member to a portion of the banknote that will not be evaluated. With the present full illumination of the banknote evaluation channel and the detecting of the edges of the banknote, such a string like member can easily be identified.

As previously considered, the present system allows exact detection of the front and back edges of a banknote and this allows synchronization of the measurement process with the current location of the banknote in the evaluation channel. With the full banknote illumination possible with the present arrangement, separate sensors for detecting the leading and trailing edges of a banknote are not required. Furthermore, the full illumination allows proved accuracy of the identification of these edges, as well as providing full information regarding the selective use of the full scan of the banknote.

Although various preferred embodiments of the present invention have been described herein in detail, it will be appreciated by those skilled in the art that variations may be made thereto without departing from the spirit of the invention or the scope of the appended claims.

The embodiments of the invention in which an exclusive property or privilege is claimed are defined as follows:

1. A method of banknote evaluation comprising moving a banknote along an evaluation path past an optical sensing arrangement where the precise location of the banknote relative to the optical sensing arrangement is not known, using said optical sensing arrangement to generally illuminate the banknote as it moves past said sensing arrangement, focusing reflected light from the illuminated banknote surface onto a photo array to provide a strip analysis corresponding to at least 75% of the banknote surface, said strip analysis containing at least 50 divisions; using said strip analysis to determine the position of the banknote relative to the optical sensing arrangement and said at least 50 divisions, selectively using some of said 50 divisions to evaluate the authenticity of the banknote relative to a standard.

2. A method as claimed in claim 1 wherein said method includes evaluation of an angle of the illuminated banknote relative to the optical sensing arrangement in selecting the divisions used in the evaluation of the banknote authenticity.

3. A method as claimed in claim 1 wherein the reflected light is focused onto a photo array having at least 64 pixels and each pixel forms a division.

4. A method as claimed in claim 1 including illuminating across a width of the evaluation path such that 100% of the surface of the banknote facing the optical sensing arrangement is illuminated and said photo array receives reflected light across the width of the evaluation channel.

5. A method as claimed in claim 4 including using said divisions to determine edge regions of the banknote relative to the photo array and using only the divisions representing a response from the banknote.

6. A method as claimed in claim 1 wherein said step of focusing includes at least 3 lenses to converge the reflected light onto the photo array.

7. A method as claimed in claim 1 wherein said step of selectively using said at least 50 divisions includes a series of evaluations of different divisions that varies according to the determined position of the banknote.

8. A banknote acceptor comprising a banknote evaluation channel, means for moving a banknote through said banknote evaluation channels;

a banknote evaluation position in said evaluation channel including an illumination system for illuminating the width of a banknote as it moves past said evaluation position;

a lens arrangement for converging and focusing light reflected from the illuminated width of the banknote onto a photo sensor array;

said photo sensor array having a length with at least 50 divisions in the length thereof that receive the reflected light from the banknote width and allow investigation of different divisions corresponding to a strip portion of the banknote; and a processing arrangement for sampling said divisions as said banknote is moved through said evaluation channel and providing an assessment of the authenticity of the banknote.

9. A banknote acceptor as claimed in claim 8 wherein said illumination system illuminates said evaluation channel in a manner that the full width of the banknote is illuminated.

10. A banknote acceptor as claimed in claim 9 wherein said processing arrangement includes analysis to locate the banknote within the evaluation channel and thereafter select different divisions for analysis.

11. A banknote acceptor as claimed in claim 10 wherein said processing arrangement locates a side edge of an illuminated banknote.

12. A banknote acceptor as claimed in claim 8 wherein said processing arrangement includes analysis to locate the banknote within the evaluation channel and thereafter select different divisions for analysis.

* * * * *